United States Patent [19]

Goeders

[11] Patent Number: 4,749,223

[45] Date of Patent: Jun. 7, 1988

[54] PORTABLE PITCHING MOUND

[75] Inventor: John J. Goeders, Altoona, Iowa

[73] Assignee: True Pitch, Inc., Altoona, Iowa

[21] Appl. No.: 31,860

[22] Filed: Mar. 30, 1987

[51] Int. Cl.[4] ..... A63B 71/00

[52] U.S. Cl. ..... 273/25

[58] Field of Search ..... 273/25, 26 R; D21/199

[56] References Cited

U.S. PATENT DOCUMENTS

| | | | |
|---|---|---|---|
| D. 236,219 | 5/1975 | Goeders | 273/25 |
| 2,156,469 | 5/1939 | Boltz | 273/25 |
| 2,662,768 | 10/1948 | Madsen | 273/25 |
| 3,236,520 | 2/1966 | Friedman | 273/26 R |
| 3,479,028 | 11/1969 | Goeders | 273/25 |
| 3,703,285 | 11/1972 | Perry | 273/25 |
| 3,837,646 | 9/1974 | Goeders | 273/25 |
| 4,063,729 | 12/1977 | Hollaway | 273/25 |
| 4,306,718 | 12/1981 | Goeders | 273/25 |
| 4,561,653 | 12/1985 | Wright | 273/25 |
| 4,666,155 | 5/1987 | Stille | 273/25 |

*Primary Examiner*—Richard C. Pinkham
*Assistant Examiner*—T. Brown
*Attorney, Agent, or Firm*—Zarley McKee, Thomte, Voorhees & Sease

[57] ABSTRACT

A portable pitching mound is disclosed which is comprised of a concave horizontally disposed shell member which has a pitching rubber area. A first receptacle is indented into the surface of the shell member and is located immediately forwardly of the pitching rubber. A second indented receptacle portion is located in the forward portion of the shell member. A quantity of earthen material is located in each of the indented receptacle portions, and the earthen material is graded to conform to the contour or shape of the shell member.

13 Claims, 1 Drawing Sheet

PORTABLE PITCHING MOUND

BACKGROUND OF THE INVENTION

Portable pitching mounds of the type shown in U.S. Pat. No. 3,479,028 are comprised of a concave arcuate shell of Fiberglas material or the like. One of the principal shortcomings of these pitching mounds is that they provide at times insufficient traction for the pitcher, particularly when the pitcher is wearing steel cleats. In any event, these prior art devices do not adequately simulate the texture of a conventional earthen pitching mound.

It is therefore a principal object of this invention to provide a prefabricated pitching mound that will have traction and footing characteristics of a conventional earthern mound.

A further object of the invention is to provide a portable pitching mound of Fiberglas material or the like which has one or more earthen-filled receptacles in the principal traction areas to stimulate footing conditions of a conventional earthen mound.

These and other objects will be apparent to those skilled in the art.

SUMMARY OF THE INVENTION

The pitching mound of this invention is comprised of a concave horizontally disposed shell member which has a conventional pitching rubber secured to the upper center portion. A forward portion of the shell member is adapted to accommodate the follow-through position of a pitcher following the delivery of a pitched baseball from the pitching rubber. A first indented receptacle portion is located in the shell member in a po ition just forwardly of the pitching rubber. A second indented receptacle portion in the shell member is located on the forward portion of the shell member adjacent its forward edge. The second indented receptacle portion is of a larger area than the first indented receptacle portion. A quantity of earthen material is contained in each of the receptacle portions and is graded to conform to the shape of the concave shell member.

DESCRIPTION OF THE PREFERRED EMBODIMENT

Figure 1:
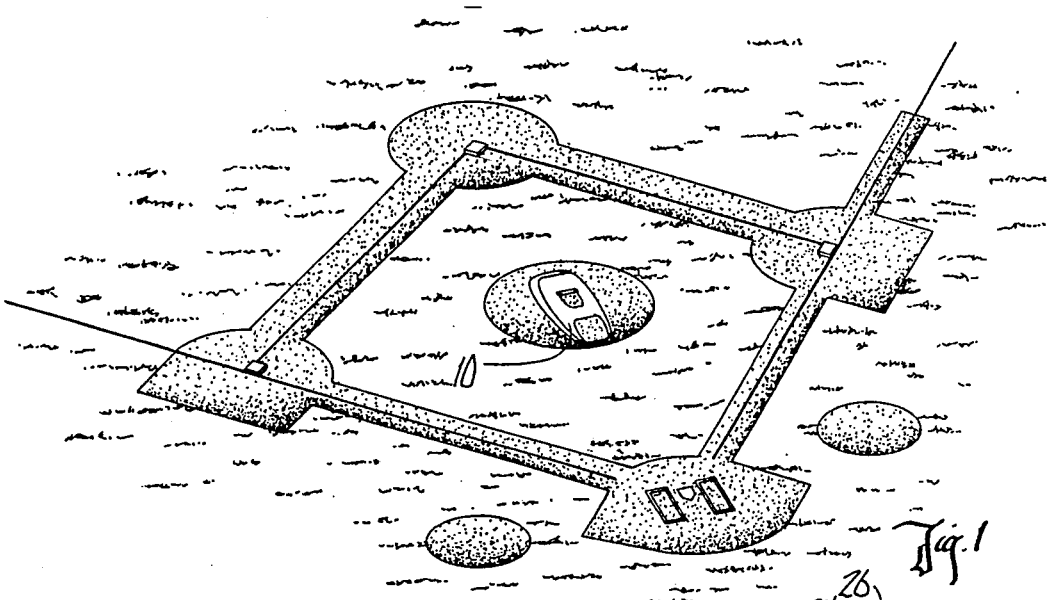
FIG. 1 is a perspective view of a conventional baseball diamond wherein the pitching mound of this invention is located.
Figure 2:
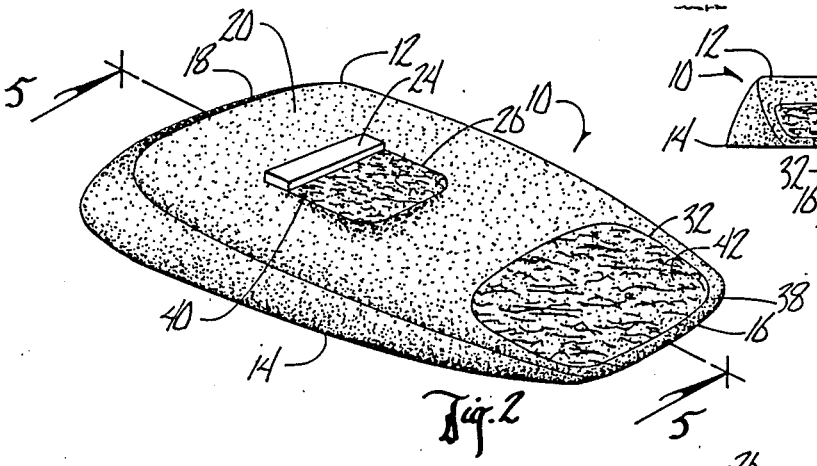
FIG. 2 is an enlarged scale perspective view of the pitching mound of this invention.
Figure 4:
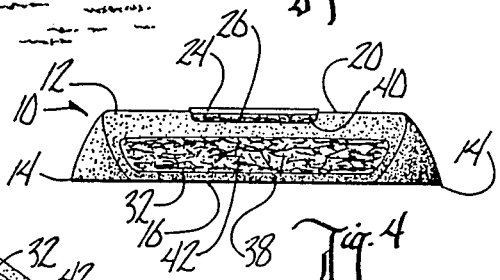
FIG. 4 is a forward elevational view thereof.
Figure 3:
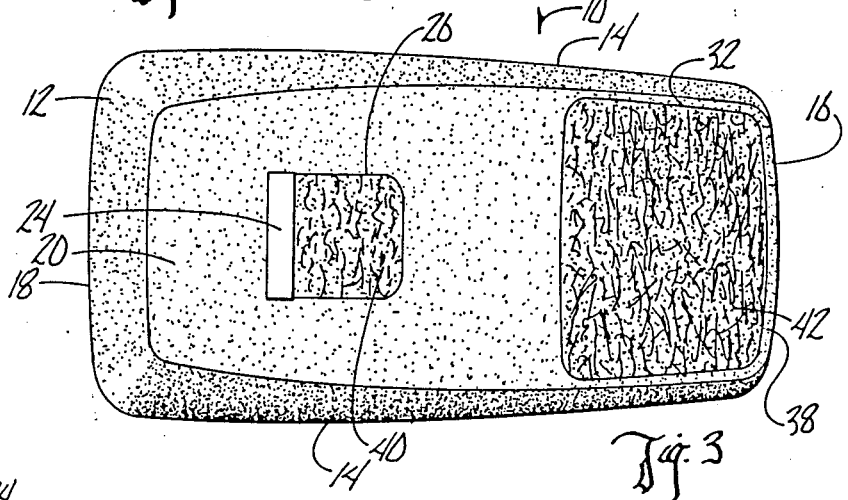
FIG. 3 is a plan view thereof.

The pitching mound 10 is comprised of a concave-shaped, molded Fiberglas body or shell member which can be of either rectangular or oval shape as viewed from above. The shell member 12 has a lower perimeter edge 14 which is adapted to engage a ground or supporting surface. Shell member 12 has a forward end 16 and a rearward end 18, with a raised deck portion 20 which normally dwells above the supporting surface.

Figure 5:
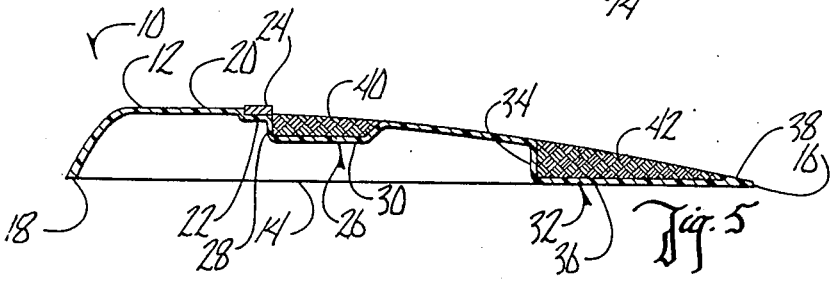
FIG. 5 is a sectional view taken on line 5—5 of FIG. 2.

As best seen in FIG. 5, shell member 12 has a slight depression 22 in which is mounted by any conventional means a conventional pitching rubber 24.

A first indented receptacle portion 26 is located directly forwardly of pitching rubber 24 and is comprised of a sidewall 28 which extends completely around the receptacle. The receptacle 26 has an open top and a closed bottom 30. The lateral width of receptacle 26 is substantially equal to the lateral width of the pitching rubber 24.

A second indented receptacle portion 32 is located adjacent the forward end of shell member 12 and is comprised of a sidewall 34 which extends along three sides of the receptacle. Receptacle 32 has an open top and a closed bottom 36. A lip 38 extends along the forward portion of the receptacle 32.

Other material such as clay or the like 40 and 42 is deposited in the receptacles 26 and 32 and is graded to conform to the shape of the concave shell member 12. This is best seen in FIG. 5.

It will be noted that the bottom 30 of receptacle 26 dwells above the lower perimeter edge 14, but the bottom 36 of receptacle 32 dwells directly on the supporting surface. The lip 38 serves to keep the earthen material 42 within receptacle 32.

Whether this pitching mound is used on a baseball or softball diamond, or in a bullpen or practice area, it is placed in its desired position with the receptacles 26 and 32 in an empty condition. Suitable earthen material is then placed in the receptacles as described heretofore, and is preferably packed so that a firm consistency thereof is achieved.

The receptacles 26 and 32 exist in the principal areas of a pitching mound that receive the greatest foot action by a pitcher. As a result, the mound is able to simulate a conventional earthen pitching mound even though it is being used in a position where a conventional mound does not exist or cannot be easily created. The earthen-filled receptacles create a very realistic and natural pitching environment for the player using the mound.

The earthen material can be removed from the receptacles at such time as it is desired to remove or store the pitching mound 10. Additional earthen material can obviously be added to the receptacles at any time if long usage thereof causes some of the original earthen material to be scattered.

It is, therefore, seen that this invention achieves at least its stated objectives.

I claim:

1. A pitching mound, comprising, a concave horizontally disposed shell member having a pitching rubber area, and a forward portion to accommodate the follow-through position of a pitcher following the delivery of a pitched baseball from said pitching rubber area, an indented receptacle portion in said shell member in a position between said pitching rubber and said forward portion, and a quantity of earthen material contained in said receptacle portion and graded to conform to the shape of said concave shell member.

2. The pitching mound of claim 1 wherein said indented receptacle portion has a bottom portion to support said earthern material.

3. The portion mound of a claim 1 wherein said indented receptacle portion has a a bottom portion and a sidewall to support said earthen material.

4. The pitching mound of claim 1 wherein a second indented receptacle portion in said shell has a bottom portion to support a quantity of earthen material, said bottom portion resting on a horizontal supporting surface supporting said pitching mound,said earthen material contained in said second receptacle being graded to conform to the shape of said shelf member.

5. The pitching mound of claim 1 wherein said indented receptacle portion is located immediately forwardly of said pitching rubber so that one or both feet of a pitcher pitching from said pitching rubber can engage the earthen material contained in said receptacle portion.

6. The pitching mound of claim 5 wherein said indented receptacle portion has a width substantially equal to the length of said pitching rubber.

7. The pitching mound of claim 1 wherein a second indented receptacle portion is located in said shell member forwardly of said indented receptacle portion, and a quantity of earthen material is contained in said second receptacle portion and graded to conform to the shape of said concave shell member.

8. The pitching mound of claim 7 wherein said receptacle portion and said second indented receptacle are spaced from each other.

9. The pitching mound of claim 7 wherein said second indented receptacle portion has a bottom portion to support said earthern material.

10. The pitching mound of claim 7 wherein said second indented receptacle portion has a bottom portion to support said earthen material with said bottom portion adapted to dwell on a horizontal supporting surface supporting said pitching mound.

11. The pitching mound of claim 7 wherein said second indented receptacle portion extends substantially to the forward perimeter edge of said shell member.

12. The pitching mound of claim 11 wherein a lip portion extends along the forward portion of said second indented receptacle portion.

13. The pitching mound of claim 7 wherein said second indented receptacle portion has a greater surface area than said first receptacle portion.

* * * * *